US005361590A

United States Patent [19]

Rathbone

[11] Patent Number: 5,361,590

[45] Date of Patent: Nov. 8, 1994

[54] AIR SEPARATION

[75] Inventor: Thomas Rathbone, Farnham, England

[73] Assignee: The BOC Group plc, Windlesham, United Kingdom

[21] Appl. No.: 65,558

[22] Filed: May 21, 1993

[30] Foreign Application Priority Data

Jun. 9, 1992 [GB] United Kingdom ..... 9212224.1

[51] Int. Cl.[5] ..... F25J 3/02

[52] U.S. Cl. ..... 62/25; 62/38

[58] Field of Search ..... 62/24, 25, 40, 38

[56] References Cited

U.S. PATENT DOCUMENTS 3,065,607 11/1962 Schilling et al. ..... 62/38
4,704,148 11/1987 Kleinberg ..... 62/24
4,715,873 12/1987 Auvil et al. ..... 62/13
4,936,099 6/1990 Woodward et al. ..... 62/24
5,098,456 3/1992 Dray et al. ..... 62/24
5,114,452 5/1992 Dray ..... 62/24

FOREIGN PATENT DOCUMENTS 0220722 5/1987 European Pat. Off. .
0384688 8/1990 European Pat. Off. .

*Primary Examiner*—Ronald C. Capossela
*Attorney, Agent, or Firm*—David M. Rosenblum; Larry R. Cassett

[57] ABSTRACT

A medium purity gaseous oxygen cycle in which reboil for the LP column is provided partly by nitrogen from the HP column and partly by a stream of air.

19 Claims, 1 Drawing Sheet

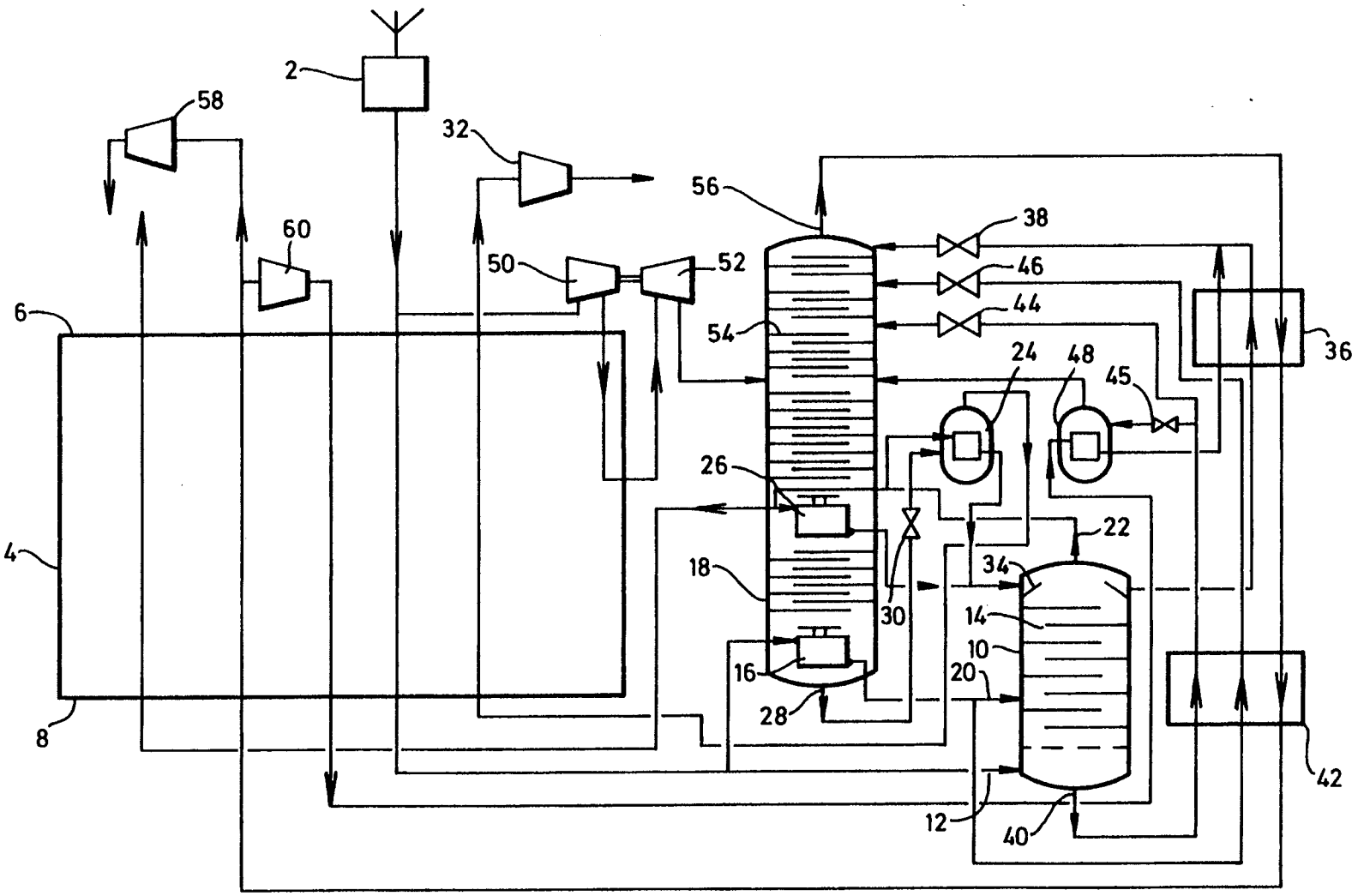
36
42
45
48
22
38
46
44
24
34
14
10
20
40
12
30
28
16
56
54
26
18
52
50
32
2
60
58
6
4
8

AIR SEPARATION

BACKGROUND OF THE INVENTION

This invention relates to a method and apparatus for separating air. The most important method commercially of separating air is by rectification. The most frequently used air separation cycles include the steps of compressing a stream of air, purifying the resulting stream of compressed air by removing water vapour and carbon dioxide, and cooling the stream of compressed air by heat exchange with returning product streams to a temperature suitable for its rectification. The rectification is performed in a so-called "double rectification column" comprising a higher pressure and a lower pressure rectification column, i. e. one of the two columns operates at higher pressure than the other. Most if not all of the air is introduced into the higher pressure column and is separated into oxygen-enriched liquid air and nitrogen vapour. The nitrogen vapour is condensed. A part of the condensate is used as liquid reflux in the higher pressure column. Oxygen-enriched liquid is withdrawn from the bottom of the higher pressure column, is sub-cooled and is introduced into an intermediate region of the lower pressure column through a throttling or pressure reduction valve. The oxygen-enriched liquid is separated into substantially pure oxygen and nitrogen products in the lower pressure column. These products are withdrawn in the vapour state from the lower pressure column and form the returning streams against which the incoming air stream is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, the lower pressure column is operated at pressures in the range of 1 to 1.5 atmospheres absolute. At such pressures, it is desirable to link the higher and lower pressure columns by using liquid oxygen at the bottom of the lower pressure column to meet the condensation duty at the top of the higher pressure column. Accordingly, nitrogen vapour from the top of the higher pressure column is heat exchanged with liquid oxygen in the bottom of the lower pressure column. Sufficient liquid oxygen is able to be evaporated thereby to meet the requirements of the lower pressure column for reboil and to enable a good yield of gaseous oxygen product to be achieved. The pressure at the top of the higher pressure column and hence the pressure to which the incoming air is compressed is arranged to be such that the temperature of the condensing nitrogen is a degree or two Kelvin higher than that of the boiling oxygen in the lower pressure column.

Many commercial processes use oxygen containing less than one percent by volume of impurities. There are however some processes, for example, coal gasification, which desirably use oxygen of lower purity, typically containing from 3 to 20% by volume of impurities. U.S. Pat. No. 4 410 343 (Ziemer) discloses that when such lower purity oxygen is required, rather have the above described link between the lower and higher pressure columns, air is employed to boil oxygen in the bottom of the lower pressure column in order both to provide reboil for that column and to evaporate the oxygen product. The resulting condensed air is then fed into both the higher pressure and the lower pressure columns. A stream of oxygen-enriched liquid is withdrawn from the higher pressure column, is passed through a throttling valve and a part of it is used to perform the nitrogen condensing duty at the top of the higher pressure column. U.S. Pat. No. 3 210 951 also discloses a process for producing impure oxygen in which air is employed to boil oxygen in the bottom of the lower pressure column in order both to provide reboil for that column and to evaporate the oxygen product. In this instance, however, oxygen-enriched liquid from an intermediate region of the lower pressure column is used to fulfil the duty of condensing nitrogen vapour produced in the higher pressure column.

It is known to take the stream of air for separation from an air compressor forming part of a gas turbine. This practice typically entails operating the higher pressure column at substantially the same pressure as the outlet pressure of the compressor. Typically, such air compressors operate at a pressure of from 10 to 20 atmospheres. If the higher pressure column is operated at such a pressure, there is a concomitant increase in the pressure at which the lower pressure column is operated.

In theory, operating the lower pressure column at a higher pressure than one in the range of 1 to 1.5 atmospheres absolute is advantageous since it reduces the effect of pressure drop in the heat exchanger in which the compressed air stream is cooled by heat exchange with the product streams. One consequence, however, of operating the lower pressure rectification column at a higher pressure is, according to our analysis, that the demand for liquid nitrogen reflux in the higher pressure column thereby tending to starve the lower pressure column of liquid nitrogen reflux while at the same time the demand for liquid nitrogen in the lower pressure rectification column also increases. As a result, a further consequence is that the liquid air stream fed to the higher pressure rectification column then has a greater adverse impact on the performance of the air separation process.

SUMMARY OF THE INVENTION

According to the present invention there is provided a method of separating air comprising the steps of:

(a) reducing by heat exchange the temperature of a compressed feed air stream to a level suitable for its separation by rectifications;

(b) introducing a first part of the temperature reduced feed air stream into a higher pressure rectification column;

(c) separating feed air in the higher pressure rectification column into oxygen-enriched liquid and nitrogen vapour fractions;

(d) condensing nitrogen vapour formed in the higher pressure column, and using one part of the resulting condensate as reflux in the higher pressure column, and another part of the resulting condensate as reflux in a lower pressure rectification column;

(e) operating the lower pressure rectification column at a pressure at its top in the range of 2 to 8 bar absolute;

(f) introducing a stream of said oxygen-enriched liquid into the lower pressure column and separating from it an impure oxygen product containing at least 3% by volume of impurities;

(g) withdrawing nitrogen and impure product oxygen streams from the lower pressure column and employing them in said heat exchange so as to reduce the temperature of the compressed air stream; and (h) boiling said impure liquid oxygen so as to provide reboil for the lower pressure column and to change the phase of the product oxygen stream;

wherein a part of the impure liquid oxygen is boiled by heat exchange with a second part of the temperature reduced feed air stream, at least some of the said second part thereby being condensed, a part of the resulting condensed air is introduced into the higher pressure column, and another part of the impure liquid oxygen is boiled by employing it to condense the nitrogen vapour in the said step (d).

The invention also provides apparatus for separating air, comprising:

(a) a main heat exchanger for reducing by heat exchange the temperature of a compressed feed air stream to a level suitable for its separation by rectification;

(b) a higher pressure rectification column for separating a part of the compressed feed air stream into oxygen-enriched liquid and nitrogen vapour fractions;

(c) a condenser-reboiler for condensing nitrogen vapour formed in the higher pressure rectification column and for returning a part of the condensed nitrogen to the higher pressure rectification column as reflux;

(d) means for introducing a stream of said oxygen-enriched liquid into a lower pressure rectification column for separating an impure liquidoxygen fraction therefrom, said lower pressure rectification column being adapted to operate at a pressure in the range of 2 to 8 bars absolute;

(e) means for introducing another part of the condensed nitrogen into the lower pressure column as reflux;

(f) means for withdrawing a vaporous nitrogen stream from the top and an impure liquid oxygen stream from the bottom of the lower pressure rectification column;

(g) means for introducing the impure liquid oxygen stream into said condenser-reboiler so as to condense said nitrogen vapour and to boil said impure liquid oxygen to form an impure gaseous product oxygen stream containing at least 3% by volume of impurities;

(h) means for passing the impure product oxygen and vaporous nitrogen streams through the main heat exchanger countercurrently of the compressed air stream; and (i) another condenser-reboiler for producing reboiled impure oxygen for the lower pressure rectification column by heat exchange of impure liquid oxygen with a condensing second part of the temperature reduced air stream, said another condenser-reboiler having an outlet for condensed air communicating with an inlet to the higher pressure rectification column, By employing the second part of the temperature reduced air stream to perform only part of the duties of providing reboil for the lower pressure column and evaporating the impure oxygen product, the rate at which liquid air is formed can be limited and hence the proportion of the air entering the higher pressure column in the liquid state can be kept down. This therefore makes available more condensed liquid nitrogen as reflux for the lower pressure column.

Typically, the second part of the temperature reduced air stream is used to perform all the duty of reboiling the impure liquid oxygen for the lower pressure column and none of the duty of evaporating the impure oxygen product. In such examples of the method according to the invention, impure liquid oxygen is preferably withdrawn from the bottom of the column, is passed through a throttling valve so as to reduce the pressure to which it is subjected, and is introduced into a condenser-reboiler, in which it is boiled by heat exchange with condensing nitrogen from the higher pressure column. It is desirable to condense further nitrogen from the higher pressure column. Such further condensation is preferably performed by heat exchange with liquid from the lower pressure column of a composition intermediate the extremes of liquid composition at the top and bottom of the lower pressure column. This heat exchange between the nitrogen from the higher pressure column and the liquid of intermediate composition is preferably performed in a condenser-reboiler outside the lower pressure column, thereby enabling the resulting stream of boiled liquid to be returned to the lower pressure column at a level where its composition is approximately the same as that of the vapour into which it is returned.

Preferably, the production of liquid nitrogen reflux for the lower pressure column is further enhanced by taking a part of the nitrogen product stream from downstream of its heat exchange with the compressed air stream, compressing it, reducing its temperature by heat exchange with the product impure oxygen and nitrogen streams, and condensing it. The condensation of the compressed nitrogen stream is preferably performed by heat exchange with a part of the oxygen-enriched liquid stream upstream of the introduction of the oxygen-enriched stream into the lower pressure column. The entire oxygen-enriched liquid stream is typically subcooled upstream of this heat exchange, and said part of it is preferably passed through a throttling valve into another condenser-reboiler in which the heat exchange takes place.

Preferably, a part of the compressed air stream is taken from upstream of its heat exchange with the impure product oxygen stream and is then compressed, cooled by heat exchange with the impure product oxygen stream and nitrogen stream, but to a temperature higher than that to which the remainder of the compressed air stream is cooled, expanded with the performance of external work and introduced into the lower pressure column. The expansion of the air with the performance of external work is preferably performed in a turbine, and the external work is preferably the compression of the air upstream of the turbine. Preferably, a part of the liquid air formed by heat exchange of the second part of the temperature reduced air with the impure oxygen is introduced into the lower pressure column.

The method and apparatus according to the present invention are particularly suited for use in producing an impure oxygen product containing from 5 to 20% by volume of impurities. The lower pressure column is preferably operated at a pressure (at its top) of from 3 to 8 bars. The higher pressure column is preferably operated at a pressure (at its top) of from 10 to 20 bars.

The compressed feed air stream is desirably purified by removal therefrom of water vapour and carbon dioxide. The purification can be accomplished by any method Known in the art.

BRIEF DESCRIPTION OF THE DRAWINGS

The method and apparatus according to the present invention will now be described by way of example with reference to the accompanying drawing which is a schematic flow diagram of an air separation plant.

DETAILED DESCRIPTION

Referring to the drawing, a compressed feed air stream which may, for example, be bled from an air compressor (not shown) forming part of a gas turbine (not shown) is passed at a pressure of about 15 bar through a purification apparatus 2 effective to remove water vapour and carbon dioxide therefrom. The apparatus 2 employs beds of adsorbent (not shown) to effect this removal of water vapour and carbon dioxide. The beds are operated out of sequence with one another such that while one or more beds are being used to purify air the remainder are being regenerated for example by means of a stream of hot nitrogen. Such purification apparatus and its operation is well Known in the art and need not be described further.

The purified feed air stream is then divided into major and minor subsidiary air streams. The major subsidiary air stream flows through a main heat exchanger 4 from its warm end 6 to its cold end 8. The major subsidiary air stream is thereby reduced in temperature from about ambient temperature to a temperature suitable for its separation by rectification. The major subsidiary air stream typically leaves the cold end 8 of the main heat exchanger 4 as a vapour at its saturation temperature. The major subsidiary air stream is then divided into first and second parts. The first part is introduced into a bottom region of a higher pressure rectification column 10 through an inlet 12. The higher pressure rectification column 10 contains liquid-vapour contact trays 14 and associated downcomers (not shown) whereby a descending liquid phase is brought into intimate contact with an ascending vapour phase such that mass transfer between the two phases takes place. The descending liquid phase becomes progressively richer in oxygen and the ascending vapour phase progressively richer in nitrogen. Since air is introduced into the bottom region of the higher pressure column 10, the liquid at the bottom of the column is approximately in equilibrium with such air, and since oxygen is less volatile than the other main components (nitrogen and argon) of the air, therefore contains a greater mole fraction of oxygen than the incoming gaseous air. On the other hand, the vapour at the top of the higher pressure column 10 comprises substantially pure nitrogen.

The second part of the major subsidiary air stream, typically constituting 15 percent of the undivided major subsidiary air stream, flows through a first condenser-reboiler 16 and condenses therein as a result of heat exchange with an impure liquid oxygen fraction at the bottom of a lower pressure rectification column 18, the impure oxygen thereby being boiled. Although shown in the drawing as being located within the lower pressure rectification column 18, the first condenser-reboiler 16 may if desired be located outside the column 18 with the impure liquid oxygen being fed under gravity into the condenser-reboiler 16 from the column 18 and the resulting vapour being returned to the column 18. The air condensed in the condenser-reboiler 16 is divided into two subsidiary streams. One subsidiary stream, constituting 25% of the total flow of liquid air from the first condenser-reboiler 16, is introduced into the higher pressure rectification column 10 through an inlet 20 at a level above that of the inlet 12. The other subsidiary liquid air stream is passed to the lower pressure rectification column 18 as will be described below.

Liquid nitrogen reflux for the higher pressure rectification column 10 is formed by condensing nitrogen vapour taken from the top thereof through an outlet 22. The condensation is performed in second and third condenser-reboilers 24 and 26 respectively. A part of the nitrogen vapour stream that leaves the higher pressure rectification column 10 through the outlet 22 is condensed in the second condenser-reboiler 24 by heat exchange with a stream of impure product oxygen which is withdrawn as a liquid from the bottom of the lower pressure rectification column 18 through an outlet 28, is passed through a throttling valve 30 to reduce its pressure to 5.1 bar, and is then passed into the second reboiler-condenser 24 at a temperature of 1O8.5K. The impure liquid oxygen is boiled in the second reboiler-condenser 24 and the resulting vapour passes through the main heat exchanger 4 countercurrently to the major subsidiary air stream, thereby being warmed to approximately ambient temperature. If necessary, the oxygen product may be compressed in a compressor 32 to bring to a pressure suitable for its subsequent use, for example as an oxidant in a coal gasification process.

Another part of the nitrogen vapour stream that leaves the higher pressure rectification column 10 through the outlet 22 is condensed in the third condenser-reboiler 26 by heat exchange with a boiling liquid fraction of a composition intermediate those of the liquids at the bottom and top of the lower pressure rectification column 18. Although the third condenser-reboiler 26 is shown in the drawing in a location within the lower pressure rectification column 18, it is preferably situated outside the column 18. In such an arrangement, liquid is withdrawn from a chosen intermediate level (or stage) of the column 18, is reboiled by heat exchange with the condensing nitrogen vapour and Is returned to the column 18 at a level below that from which it was originally taken, the return level being one where the composition of the vapour approximates closely to that of the returning vapour. Typically the liquid so withdrawn from the intermediate level of the column 18 contains 62% by volume of oxygen and is at a temperature of 105.4K.

The nitrogen condensed in the condenser-reboilers 24 and 26 is returned to a collector 34 at the top of the higher pressure column 10. A part of it is used as reflux in the higher pressure rectification column 10 while the remainder is withdrawn from the collector 34, is sub-cooled in a heat exchanger 36, Is passed through a throttling valve 38, and is introduced into the top of the lower pressure column 18 as liquid nitrogen reflux.

The lower pressure rectification column Is used to separate three distinct streams of air into nitrogen and impure oxygen products. The impure oxygen product typically includes 85% by volume of oxygen. The lower pressure rectification column 18 typically operates at a pressure at its top of 6.0 bar.

One of the three sources of the air that Is separated in the lower pressure rectification column 18 is oxygen-rich liquid air formed at the bottom of the higher pressure rectification column 10. A stream of this oxygen-enriched liquid is withdrawn from the column 10 through an outlet 40, is sub-cooled by passage through a heat exchanger 42, and is downstream of the heat exchanger 42 divided into two sub-streams. One sub-stream is passed through a throttling valve 44 and is introduced into the lower pressure rectification column 18 at a level (or separation stage) where the liquid is of approximately the same composition. The other sub-stream is passed through a throttling valve 45 in order to reduce its pressure to 6.15 bar and is introduced at this pressure into a fourth condenser-reboiler 48 in which it is reboiled by heat exchange with a condensing nitrogen recycle stream as will be described below. The resulting vaporised stream is then introduced into the lower pressure rectification column 18 at a level below that at which said one sub-stream enters the column 18.

A second of the three sources of the air that is separated in the lower pressure rectification column is the second subsidiary liquid air stream produced by the first condenser-reboiler 16. This stream is sub-cooled by passage through the heat exchanger 42, is reduced in pressure to the operating pressure of the lower pressure rectification column 18 by passage through a throttling valve 46 and is introduced into the lower pressure column 18 at level above that at which the oxygen-rich liquid air stream enters the column 18.

The third source of the air that is separated in the lower pressure rectification column 18 is the minor subsidiary air stream that is formed from the air purified in the apparatus 4. This air is compressed to a pressure of 21.3 bar in a compressor 50, is passed through the main heat exchanger 4 concurrently with the major subsidiary air stream, is withdrawn from the heat exchanger at a temperature of 207K, is expanded in an expansion turbine 52 to the operating pressure of the lower pressure column and is introduced into the lower pressure rectification column 18 at a temperature of 152K. This expanded air is typically introduced into the column 18 at the same level as the air from the fourth condenser-reboiler 48. The rotor (not shown) of the turbine 52 is preferably mounted on the same shaft as the rotor or rotors (not shown) of the compressor 50 such that the turbine 52 is able to drive the compressor 50.

The lower pressure rectification column 18 contains liquid-vapour contact trays 54 and associated downcomers (not shown) whereby a descending liquid phase is brought into intimate contact with an ascending vapour phase such that mass transfer between the two phases takes place. The descending liquid phase becomes progressively richer in oxygen and, as described above, an impure liquid oxygen product containing 85% by volume of oxygen is formed at the bottom of the column. The ascending vapour phase becomes progressively richer in nitrogen. A substantially pure nitrogen stream is withdrawn from the top of the lower pressure rectification column through an outlet 56 and flows in sequence through the heat exchangers 36 and 42 countercurrently to the other streams passing therethrough, thereby enabling these other streams to be sub-cooled. Downstream of the heat exchanger 42 the nitrogen stream flow through the heat exchanger 4 from its cold end 18 to its warm end 6. The nitrogen is thereby warmed to approximately ambient temperature. About 75% of the nitrogen is then taken as product and may be compressed in a compressor 58 to raise its pressure to a level suitable for its introduction, for example, into the combustion chamber (not shown) of a gas turbine (not shown). The remainder of the nitrogen stream is compressed in a compressor 60 to a pressure of 11 bar and the resulting compressed nitrogen stream is returned through the main heat exchanger 4 from its warm end 6 to its cold end 8. The thus cooled nitrogen stream provides the necessary heating for the fourth condenser-reboiler 48 and is itself condensed. The resulting stream of condensed nitrogen is sub-cooled by passage through the heat exchanger 36 and is mixed upstream of the throttling valve 38 with the sub-cooled stream of liquid nitrogen taken from the collector 34. Accordingly, the nitrogen that is recycled via the compressor 60 enhances the rate at which liquid nitrogen reflux is supplied to the lower pressure column 18.

Each of the compressors 32, 50 and 60 typically has an aftercooler (not shown) associated therewith to remove the heat of compression from the compressed gas.

The lower pressure rectification column 18 of the above described air separation process has been found by a McCabe-Thiele analysis to be able to be operated relatively close to reversibility in comparison with conventional air separation process, and it has been calculated that the energetic efficiency of this column can exceed 80%.

Various changes and modifications may be made to the process described with reference to the drawing. For example, if desired, nitrogen product may be taken from the higher pressure column 10 in addition to the one from the lower pressure column 18. As shown in the drawing, this additional nitrogen product may be passed through the heat exchanger 4 from its cold end 8 to its warm end 6 so as to warm it to about ambient temperature.

I claim:

1. A method of separating air comprising the steps of:

a) reducing by heat exchange the temperature of a compressed feed air stream to a level suitable for its separation by rectification;

b) introducing a first part of the temperature reduced feed air stream into a higher pressure rectification column;

c) separating feed air in the higher pressure rectification column into oxygen-enriched liquid and nitrogen vapour fractions;

d) condensing nitrogen vapour formed in the higher pressure column, and using one part of the resulting condensate as reflux in the higher pressure column, and another part of the resulting condensate as reflux in a lower pressure rectification column;

e) operating the lower pressure rectification column at a pressure at its top in the range of 2 to 8 bar absolute;

f) introducing a stream of said oxygen-enriched liquid into the lower pressure column and separating from it an impure oxygen product containing at least 3% by volume of impurities;

g) withdrawing nitrogen and impure product oxygen streams from the lower pressure column and employing them in said heat exchange so as to reduce the temperature of the compressed air stream; and h) boiling said impure liquid oxygen so as to provide reboil for the lower pressure column and to change the phase of the product oxygen stream;

wherein a part of the impure liquid oxygen is boiled by heat exchange with a second part of the temperature reduced feed air stream, at least some of the said second part being thereby condensed, a part of the resulting condensed air is introduced into the higher pressure column, and another part of the impure liquid oxygen is boiled by employing it to condense the nitrogen vapour in the said step (d).

2. The method as claimed in claim 1, wherein that part of the impure liquid oxygen boiled by the second part of the temperature reduced feed air stream is used as reboil in the lower pressure rectification column.

3. The method as claimed in claim 1, in which the phase of the product oxygen stream is changed in a condenser-reboiler external to the lower pressure rectification column.

4. The method as claimed in claim 3, in which the product oxygen stream is passed through a throttling valve upstream of the condenser-reboiler.

5. The method as claimed in claim 1, wherein further nitrogen vapour from the higher pressure rectification column is condensed by heat exchange with liquid from the lower pressure column of composition intermediate the extremes of liquid composition at the top and bottom of the lower pressure rectification column.

6. The method as claimed in claim 5, in which the heat exchange between the further nitrogen vapour and the said liquid from the lower pressure column is performed outside the lower pressure rectification column.

7. The method as claimed in claim 1, in which a part of the nitrogen stream withdrawn from the lower pressure column is taken from downstream of its heat exchange with the compressed air stream, is compressed, is reduced in temperature by heat exchange with the impure product oxygen and nitrogen streams, and is condensed, and the resulting condensate is used as reflux in the lower pressure rectification column.

8. The method as claimed in claim 7, in which the condensation of the compressed nitrogen stream is performed by heat exchange with a part of the oxygen-enriched liquid stream from the higher pressure column upstream of the introduction of the oxygen-enriched liquid into the lower pressure rectification column.

9. The method as claimed in claim 8, in which said part of the oxygen-enriched liquid stream is sub-cooled and reduced in pressure upstream of its heat exchange with the compressed nitrogen stream.

10. The method as claimed in claim 1, in which a part of the compressed air stream is taken from upstream of the heat exchange with the impure product oxygen and nitrogen streams, is compressed, and is cooled by heat exchange with the impure product oxygen stream, and the nitrogen stream is expanded with the performance of external work and is introduced into the lower pressure rectification column.

11. The method as claimed in claim 1, in which a part of the liquid air formed by heat exchange of the second part of the temperature reduced air with the impure oxygen is introduced into the lower pressure rectification column.

12. An apparatus for separating air, comprising:

a) a main heat exchanger for reducing the temperature of a compressed feed air stream to a level suitable for its separation by rectification;

b) a higher pressure rectification column for separating a part of the compressed feed air stream into oxygen-enriched liquid and nitrogen vapour fractions;

c) a condenser-reboiler for condensing nitrogen vapour formed in the higher pressure rectification column and for returning a part of the condensed nitrogen to the higher pressure rectification column as reflux;

d) means for introducing a stream of said oxygen-enriched liquid into a lower pressure rectification column for separating an impure liquid oxygen fraction therefrom, said lower pressure rectification column being adapted to operate at a pressure in the range of 2 to 8 bars absolute;

e) means for introducing another part of the condensed nitrogen into the lower pressure rectification column as reflux;

f) means for withdrawing a vaporous nitrogen stream from the top and an impure liquid oxygen stream from the bottom of the lower pressure rectification column;

g) means for introducing the impure liquid oxygen stream into said condenser-reboiler so as to condense said nitrogen vapour and to boil said impure liquid oxygen to form an impure gaseous product oxygen stream containing at least 3% by volume of impurities;

h) means for passing the impure product oxygen and vapour nitrogen streams through the main heat exchanger countercurrently to the compressed air stream; and i) another condenser-reboiler for providing reboiled impure oxygen for the lower pressure rectification column by heat exchange of impure liquid oxygen with a condensing second part of the temperature reduced air stream, said another condenser having an outlet for condensed air communicating with an inlet to the higher pressure rectification column.

13. The apparatus as claimed in claim 12, additionally including a throttling valve for reducing the pressure of the impure liquid oxygen stream upstream of its introduction into condenser-reboiler (c).

14. The apparatus as claimed in claim 12, additionally including a third condenser-reboiler for condensing further nitrogen vapour from the higher pressure rectification column by heat exchange with liquid from the lower pressure column of composition intermediate the extremes of liquid composition at the top and bottom of the lower pressure rectification column.

15. The apparatus as claimed in claim 14, in which the third condenser-reboiler is located outside the lower pressure rectification column.

16. The apparatus as claimed in claim 12, additionally including a compressor for compressing a part of the vaporous nitrogen stream downstream of its passage through the main heat exchanger and a fourth condenser-reboiler communicating with said compressor via the main heat exchanger for condensing said liquid nitrogen, the fourth condenser-reboiler having an outlet for liquid nitrogen condensate communicating with the top of the lower pressure rectification column.

17. The apparatus as claimed in claim 16, wherein said fourth condenser-reboiler is adapted to condense said nitrogen by heat exchange with oxygen-rich liquid withdrawn from the higher pressure rectification column.

18. The apparatus as claimed in claim 12, wherein said outlet for liquid air condensate from said condenser-reboiler (c) also communicates with an inlet to the lower pressure rectification column.

19. The apparatus as claimed in claim 12, additionally including a compressor for taking a part of the compressed feed air stream from upstream of the main heat exchanger and further compressing it; and an expansion turbine having an inlet communicating with an outlet of the compressor via a higher temperature portion of the main heat exchanger and an outlet communicating with the lower pressure rectification column.

* * * * *